US006234947B1

(12) United States Patent
Michalik

(10) Patent No.: US 6,234,947 B1
(45) Date of Patent: May 22, 2001

(54) METHOD AND DEVICE FOR CROSS-FOLDING SIGNATURES

(75) Inventor: Horst Bernhard Michalik, Höchberg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/403,025

(22) PCT Filed: Apr. 21, 1998

(86) PCT No.: PCT/DE98/01107

§ 371 Date: Oct. 20, 1999

§ 102(e) Date: Oct. 20, 1999

(87) PCT Pub. No.: WO98/47804

PCT Pub. Date: Oct. 29, 1998

(30) Foreign Application Priority Data

Apr. 21, 1997 (DE) ..... 197 16 628

(51) Int. Cl.[7] ..... B31F 1/10

(52) U.S. Cl. ..... 493/425; 493/426; 493/434; 493/442; 493/360; 493/431

(58) Field of Search ..... 493/425, 426, 493/424, 434, 442, 444, 343, 356, 360, 431, 409, 410, 405; 270/47, 6, 13, 19, 21.1, 48, 38

(56) References Cited

U.S. PATENT DOCUMENTS

| | | | | |
|---|---|---|---|---|
| 4,159,823 | * | 7/1979 | Bryer et al. | 493/425 |
| 4,465,269 | | 8/1984 | Peterson . | |
| 5,259,604 | | 11/1993 | Schneider et al. . | |
| 5,417,642 | * | 5/1995 | Boronka et al. | 493/425 |
| 5,551,678 | * | 9/1996 | Michalik et al. | 493/428 |
| 5,653,429 | * | 8/1997 | Michalik et al. | 493/426 |
| 5,860,342 | | 1/1999 | Hillebrand et al. . | |
| 6,071,224 | * | 6/2000 | Lanvin et al. | 493/425 |

FOREIGN PATENT DOCUMENTS

| | | |
|---|---|---|
| 80044 | 11/1971 | (DE) . |
| 2146013 | 3/1973 | (DE) . |
| 3143243 A1 | 5/1983 | (DE) . |
| 4120630 C1 | 11/1992 | (DE) . |
| 19533064 A1 | 9/1996 | (DE) . |
| 0716038 A2 | 11/1995 | (EP) . |

* cited by examiner

*Primary Examiner*—Stephen F. Gerrity
*Assistant Examiner*—Sam Tawfik
(74) *Attorney, Agent, or Firm*—Jones, Tullar & Cooper, PC

(57) ABSTRACT

Signatures that are cross-folded to form cross folded products can be formed without damaging the product whether the cross-folded product is thick or thin. The signatures are given a pre-fold by a pre-fold cylinder that utilizes a plurality of pre-fold gripping element systems. The pre-folded product is carried by the pre-fold cylinder to a pair of folding rollers which finish fold the cross-folded signatures.

18 Claims, 3 Drawing Sheets

METHOD AND DEVICE FOR CROSS-FOLDING SIGNATURES

FIELD OF THE INVENTION

The present invention relates to a method for the transverse folding of signatures as well as to an associated device. This method and device pre-folds signature prior to finish-folding them.

DESCRIPTION OF THE PRIOR ART

It is generally known to produce transversely folded products wherein a plurality of paper ribbon sections conducted one above the other, and called signatures, are respectively pushed into folding jaws of a folding jaw cylinder by means of folding blades of a folding blade cylinder.

Only transversely folded products of up to 96 pages can be produced by means of such folding devices, because otherwise the inner and outer portions of the transversely folded product would be damaged.

DE-OS 21 46 013, describes a device for longitudinally folding sheets of paper. Here, sheets of paper are pre-folded between a rotating circle-shaped folding blade and an annular groove of a rotating pre-fold cylinder, and are subsequently finish-folded by means of a pair of belts.

DE 41 20 630 C1 discloses a device for transversely folding a web in a rotary printing press. Here, a folding blade cylinder and a folding jaw cylinder are arranged for making a first transverse fold.

SUMMARY OF THE INVENTION

The object of the present invention is based on providing a method, as well as an associated device for producing a transverse fold.

In accordance with the invention, this object is attained by providing the signatures with a pre-fold through the use of pre-fold clamping elements, such as folding jaws. The pre-folding signatures are then conducted to a pair of rotating folding rollers where they are finish-folded.

The advantages which can be achieved with the present invention rest, in particular, in that thick folded products of up to 192 pages can be transversely folded with comparatively little force. An exact transverse fold can be exactly determined in that the center of the fold can be exactly defined, particularly since both halves of the signatures are respectively drawn into the pre-fold clamping gap by the same amount of the insertion of the folding blade. Since transverse folding takes place in two stages, pre-folding and finish-folding, the forces respectively required for one folding step are reduced. The lateral faces of the pre-fold product, which are in contact with the pre-fold clamping gap, are handled free of damage because of the employment of cylindrical pre-fold clamping elements of the pre-fold clamping system which are operating in a jaw-like manner. In the same way, the finish-folding of the pre-folded product of up to 192 pages takes place free of damage because of the employment of folding rollers.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENTS

Figure 1:
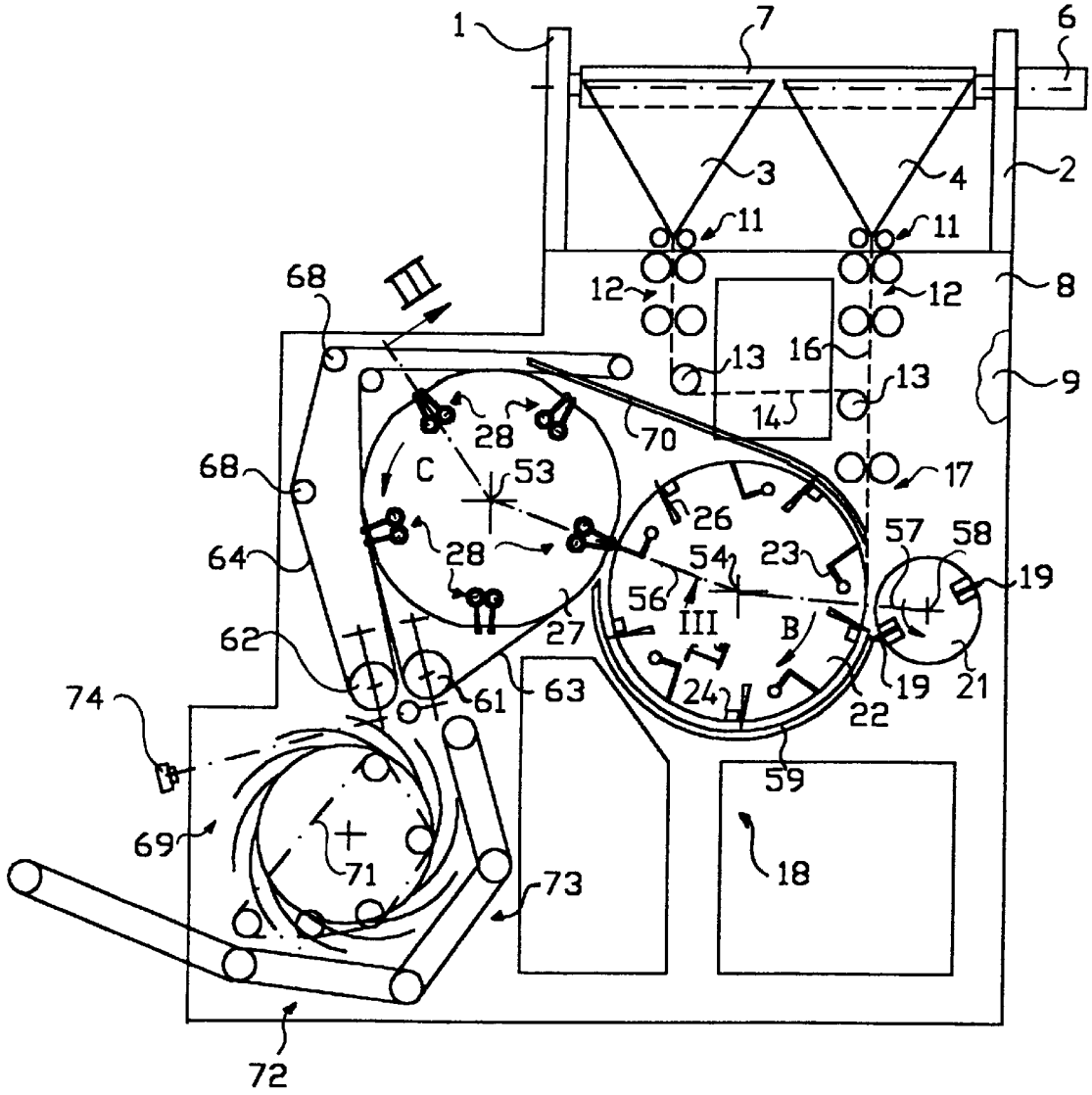
FIG. 1, a cross section through a schematic representation of a folding apparatus in accordance with the present invention.

Two longitudinal folding funnels or hoppers 3, 4 are arranged between two lateral frames 1, 2, which have a funnel or hopper inlet roller 7, driven by a motor 6, on their paper inlet side, all as seen in FIG. 1. On their hopper outlet side respectively one pair of funnel or hopper folding rollers 11, located between lateral frames 8, 9, respectively one drawing roller group 12, as well as transfer rollers 13, are arranged. These conduct one or several paper ribbons 14, 16 via a main drawing roller group 17 to a transverse cutting and transverse folding device 18, also seated between the lateral frames 8, 9. The transverse cutting and transverse folding device 18 has a known, two-piece, i.e. provided with two cutters 19, cutting cylinder 21, which, in turn, operates against a known, five-piece folding blade, grooved strip and point spur cylinder 22, which is also called a five piece or field transport and folding blade cylinder. This cylinder 22 has, respectively arranged on its circumference, five folding blades and folding blade fixtures 23, grooved strips 24 and point spur systems 26.

Figure 2:
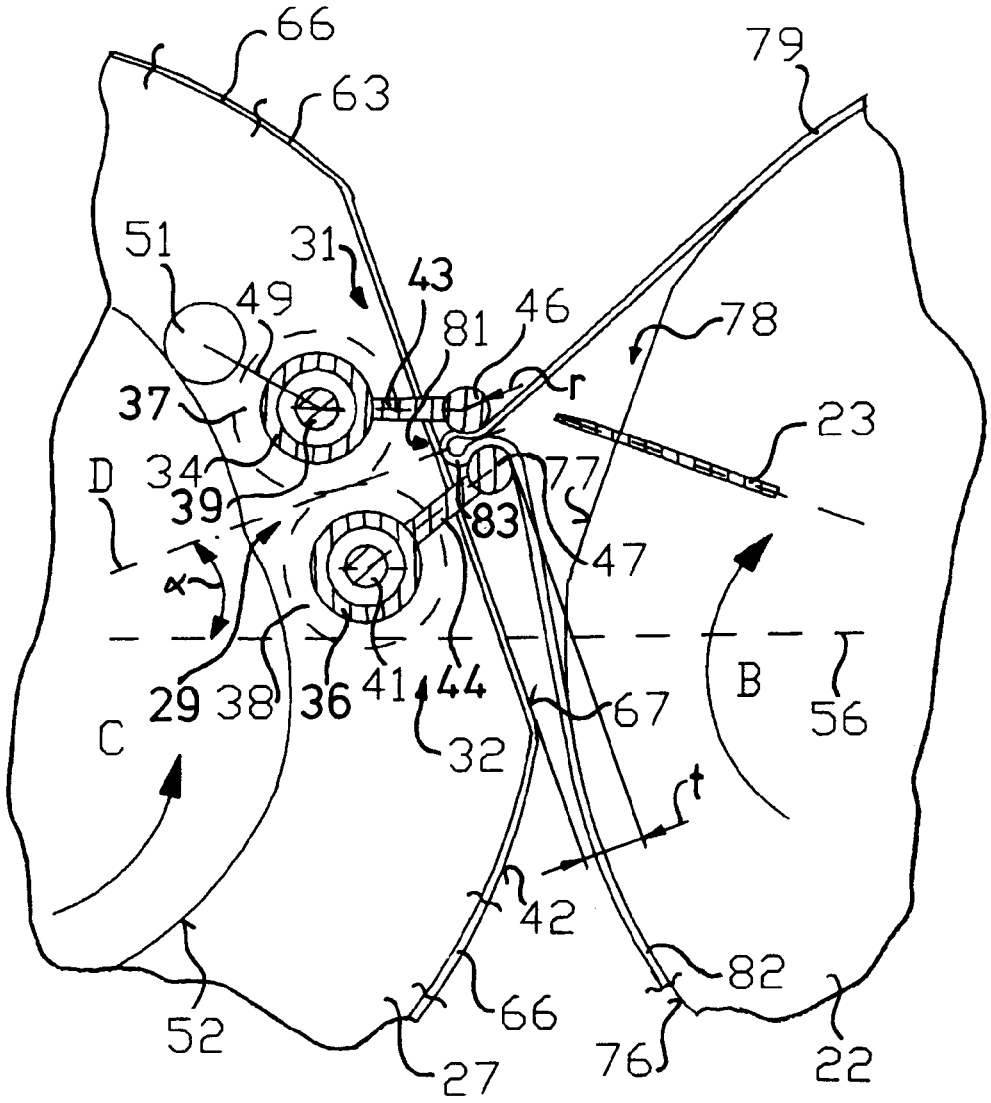
FIG. 2, a cross section through an enlarged schematic representation of a pre-fold clamping element which has just picked up a transversely-folded product; an in FIG. 3, a longitudinal section taken along line III—III in FIG. 1, wherein only one end of a pre-fold cylinder with a central control of the pre-fold clamping element system is represented.

The transverse cutting and transverse folding device 18 furthermore has a rotating body, for example a pre-fold cylinder 27, with a number n, for example three, five or seven, but preferably five, pre-fold clamping element systems 28, distributed at even distances over its circumference, which respectively work together with the folding blade fixtures 23 of the cylinder 22, all as may be seen in FIGS. 1 and 2.

Figure 3:
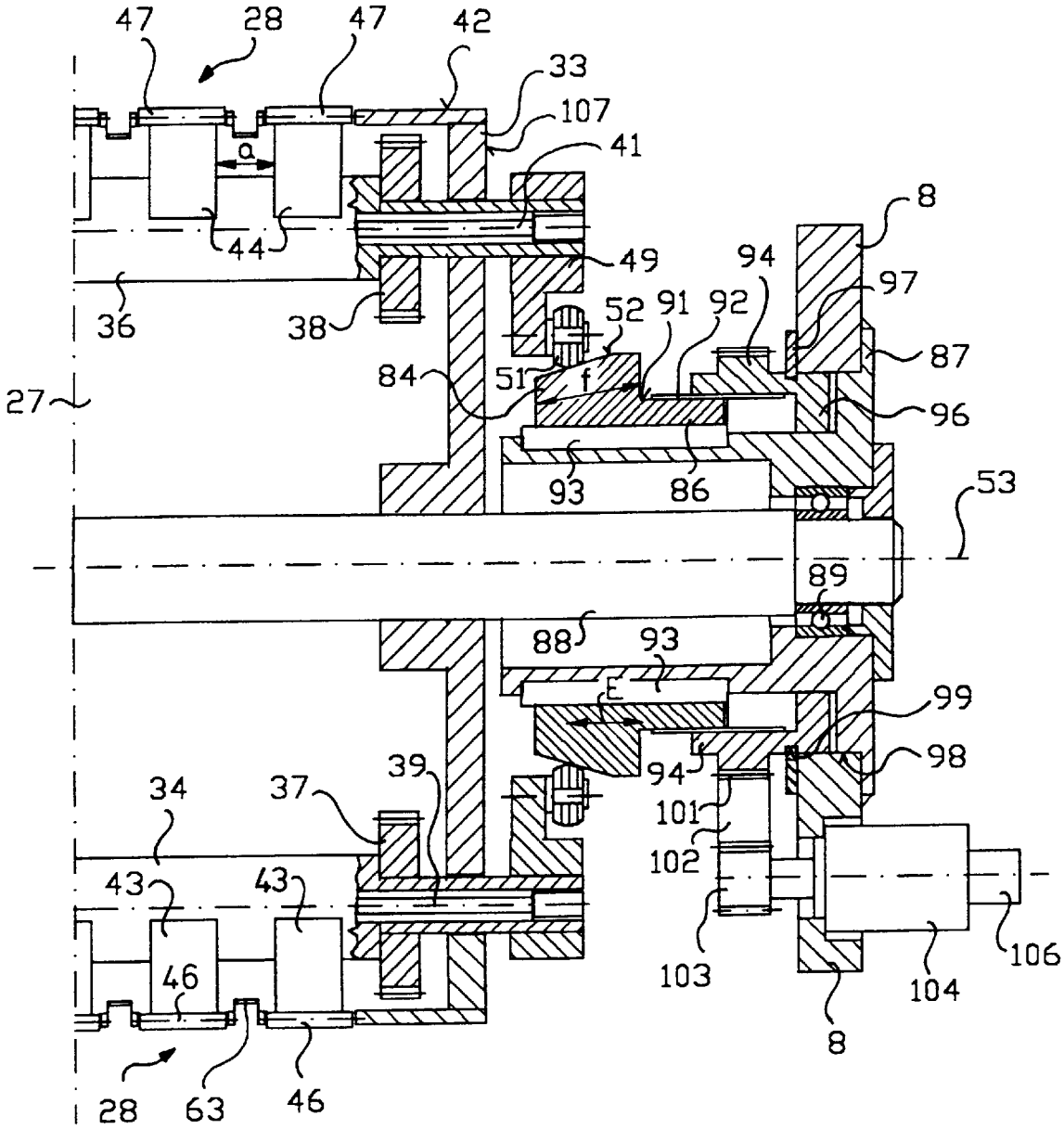

Each one of the pre-fold clamping element systems 28 consists of from a number m of two to ten pairs of folding-jaw-like pre-fold clamping elements 31, 32, which pairs of clamping elements 31, 32 are arranged in the axis-parallel direction of the pre-fold cylinder 27 next to each other and spaced apart from each other at a clear spacing distance "a", as shown in FIG. 3 and which operate in a jaw-like manner.

Between lateral or end walls 33 of the pre-fold cylinder 27—only one lateral wall 33 of pre-fold cylinder 27 being represented in FIG. 3—two shafts 34, 36, for example hollow shafts, are equipped with the pre-fold clamping elements 31, 32. The ends of the shafts 34, 36 are seated in the lateral walls 33 of the pre-fold cylinder 27 and are synchronized with each other by means of tooth segments 37, 38 fixed on the shaft, or by gear wheels. A torsion bar 39, 41 has been inserted into the center of the shaft 34, 36. Respectively, one end of the torsion bar 39, 41 is connected with the shaft 34, 36, the other end of the torsion bar 39, 41 is fixed in place in a clamping device, not specifically represented.

This clamping device for each torsion bar 39, 41 is located on the outside of the lateral wall, not represented, which lies opposite the lateral wall 33.

Each pre-fold clamping element 31, 32 is embodied with an enlargement at its end near the periphery, as well as on the side which enlargement or lobe is in contact with the pre-fold product, as depicted in FIG. 2. For this purpose, the shaft 34 has finger-like, spring-elastic or resilient supports 43, oriented radially in the direction toward the periphery 42 of the pre-fold cylinder 27 and spaced apart from each other at a distance "a", as shown in FIG. 3. On its outer end, near the periphery 42 of the pre-fold cylinder, each support 43 has an enlargement or lobe 46, extending in the axis-parallel direction with respect to the axis of rotation of the pre-fold cylinder 27. This means that the end of the pre-fold clamping elements 31, 32, acting on the folded product, projects radically outwardly in respect to the support 43.

In the same way, the respective second shaft 36 has spring elastic supports 44, each with a cylindrical enlargement or lobe 47. The supports 43, 44 with the enlargement or lobes 46, 47 respectively operate together as pairs 29 of pre-fold clamping elements.

It is also possible to design the supports 43, 44 and the associated enlargement 46, 47 in one piece.

These ends, provided with enlargements, can be used not only with pre-fold clamping elements 31, 32, but also generally in connection with folding jaws.

A control arm 49 is located on one of the shafts, for example the shaft 34, and is fixed against relative rotation on the shaft end which has the clamping point of the torsion bar 39 or 41. On its end remote from the torsion bar, the control arm 49 has a roller 51, which runs off on a known control cam track 52 of a control cam 84, which is fixed in place on the lateral frame 8, all as shown in FIG. 3.

Axes of rotation 53, 54 of the pre-fold cylinder 27, as well as of the folding blade, grooved strip and point spur cylinder 22 are spaced apart by means of an imagined center line 56, and the axis of rotation 54 is distanced by means of an imagined central line 57 from an axis of rotation 58 of the cutting cylinder 21. The folding blade cylinder 22 is surrounded below these central lines 56, 57 by paper guide rods 59, fixed in place on the lateral frame, as may be seen in FIG. 2.

Two folding rollers 61, 62 for finish-folding the printed products, which folding rollers 61, 62 are resiliently seated in respect to each other between the lateral frames 8, 9 and are also a part of the transverse cutting and transverse folding device 18, are arranged downstream of the pre-folding cylinder 27. The transport of pre-folded printed products between the pre-fold cylinder 27 and the folding rollers 61, 62 takes place by means of two cooperating belt systems 63, 64.

The belts of the first belt system 63 are guided on the circumference 42 of the pre-fold cylinder 27 in grooves 66 located between the pairs 29 of pre-fold clamping elements 31, 32, as well as on a portion of the circumference of the first folding roller 61. The pre-fold cylinder 27 has a secant-like surface portion 67 as seen in FIG. 2 compared to the periphery 42 of the remainder of cylinder 27, with this secant-like surface portion 67 extending in an axis-parallel direction, respectively at those locations of the grooves 66 of the pre-fold cylinder 27 at which a pre-fold clamping element system 28 is located. Between the closed pairs 29 of the pre-fold clamping elements 31, 32 this secant-like surface 67 has a depth "t", which is greater than twice the radius r of the enlargements or lobes 46, 47 formed on the outer ends of the finger-like spring elastic supports 43, 44.

Also, respectively one secant-shaped surface 77, extending in an axis-parallel direction to the axis of rotation of the transport and folding blade cylinder 22, is provided on the circumference 76 of the transport and folding blade cylinder 22 at the place where folding blades 23 are arranged.

By means of belt guide rollers 68, the second belt system 64 is conducted above, and at the side of the pre-fold cylinder 27 partially around the pre-fold cylinder 27, as well as around the second folding roller 62. Both belt systems 63, 64 act together.

The clear distance between the two folding rollers 61, 62 can be set in accordance with the thickness of the transversely folded product by means of a known folding roller gap adjustment device 74. Therefore, both folding rollers 61, 62 are resiliently seated against each other in a known way in order to temporarily compensate, without damage, a thickening of folding products, for example after the change and the connection of paper webs.

Paper guide rods 70, fixed in place in the lateral frames, are arranged above the cylinders 22, 27 between the entry of the paper ribbons 14, 16 and the second belt system 64.

A known paddle wheel 69 with a known ejection system 71 for printed products, for depositing the transversely folded products on a delivery belt 72, is arranged below the folding rollers 61, 62 in the lateral frames 8, 9. A guide belt 73, located at the side of the paddle wheel 69 in the vertical direction, is arranged upstream of the delivery belt 72.

The opening width of the pairs 29 of pre-fold clamping elements 31, 32 can be adjusted by means of the shape of the control cam track 52.

For the purpose of setting the product thickness of the signatures 78 which are to be pre-folded, the control cam track 52 has a width f, viewed in cross section in the axial direction, which corresponds to several times the width g of the roller track. In cross section, i.e. across a width of the control cam 84, the control cam track 52 has a rise, which increases in the direction toward the lateral frame 8. Accordingly, the control cam 84 is embodied in the shape of a truncated cone and is arranged to be displaceable in the axial direction E of the pre-fold cylinder 27. The control cam 84 has a centered bore and is laterally fastened on a sleeve-shaped control cam support 86, wherein an interior diameter of the centered bore and an interior diameter of the control cam support 86 are equal, and both elements 84, 86 are preferably made as one piece, as may be seen in FIG. 3.

The control cam support 86 is arranged coaxially with the control cam 84 on a bearing bushing 87, which is fixed in place on the lateral frame, and which, in turn, receives in its interior a shaft journal 88 of the pre-fold cylinder 27, seated in a roller bearing 89. On its surface 91, the sleeve-shaped portion of the control cam support 86 has an exterior thread 92 and is seated, fixed against relative rotation, axially displaceably on the control cam support 86 by means of a feather key 93, for example.

A sleeve 94 with an interior thread, and which is connected as one piece with a guide ring 96 on the side close to the lateral frame, is in engagement with the exterior thread 92 of the control cam support 86. The guide ring 96 is rotatably supported with its inner running surface on the surface 91 of the control cam support 86, and is secured against axial displacement, for example by means of a two-piece holding ring 97, which is fixed in place on the lateral frame and engages an annular groove 99 circumscribed in an outer surface 98.

On its outer surface 98, the sleeve 94 with the interior thread has teeth 101 which are connected, for example by means of a toothed belt 102, with a toothed disk 103 of a motor 104, fixed in place on the lateral frame, all as may be seen in FIG. 3. An angle encoder 106 is connected, fixed against relative rotation, with the motor 104.

If it is now intended to change the pre-fold clamping gap 81 because of the different thickness of another folded product, the sleeve 94 with the interior thread is rotated by means of the drive 104 to 101, so that, by means of this rotation of sleeve 94, the control cam support 86 is moved in the axial direction E. If the roller 51 now rides on the control cam track 52 in another, for example a higher, position than represented in FIG. 3, the width of the pre-fold clamping gap 81 is reduced.

Instead of the running surface of the control roller 51 being crowned, when viewed in cross section, it can also be designed in the form of a truncated cone and thus can adapt itself to the rise in the control cam track 52. In this case, the rise of the control cam track 52 corresponds to the amount of the stroke of the control roller 51.

With this, it is also possible to adjust the width of folding jaws in folding jaw cylinders.

In accordance with a second preferred embodiment, the control cam track 52 can also be arranged fixed in place on the lateral frame, and the control arm 49 supporting the roller 51 can be adjustable in the axial direction on the spindle, or respectively the torsion bar 41. However, it is essential that the control cam track 52, which is inclined in respect to the axis of rotation 53 of the pre-fold cylinder 27, is arranged displaceably in relation to the cam roller 51.

In accordance with another preferred embodiment, the roller 51, which is located on the control arm 49 and whose axis of rotation 108 extends at right angles in respect to the longitudinal axis of the control arm, can also run off on a control cam track which, viewed in cross section, is level and extends in the axial direction 53 of the pre-fold cylinder 27. A second cylinder-shaped roller in the form of a support roller and located on the control arm 49, whose axis of rotation extends in the longitudinal direction of the control arm 49, rolls off on an exterior 107 of the lateral wall 33 of the pre-fold cylinder 27 with an appropriate radius around the axis of rotation 53 the arrangement is not represented in the drawings.

The cylindrical support roller is used as force support of the axial forces generated by the control cam.

A method for transversely folding signatures in accordance with the present invention progresses as follows:

Signatures 78 are cut from the paper ribbons 14, 16, which paper ribbons 14, 16 are conducted above each other, on the folding blade, grooved strip and point spur cylinder 22 with the cooperation of the cutting cylinder 21, and are respectively grasped at their front edge of a leading element 79 of the signature 78, pointing in the running direction B of the cylinder 22, by means of the point spur or other gripper system 26, and are conducted to a pre-fold clamping system 28 of the pre-fold cylinder 27. In the process, each signature 78, collected or uncollected, is pushed into a pre-fold clamping gap 81 of the pre-fold clamping element system 28 by means of a folding blade 23 located on the cylinder 22 as seen in FIG. 2. The leading element 79, as well as a trailing element 82 of the signature 78 is pushed into the pre-fold clamping gap 81 by the amount of the penetration depth of the folding blade 23. FIG. 2 shows a position D of the cylinders 22, 27, in which the pre-fold clamping elements 31, 32, as well as the folding blade 23 have already passed through the central line 56 by an angle of rotation $\alpha$. Following the retraction of the folding blade 23, as depicted in FIG. 2, the pre-fold clamping elements 31, 32 close pincer-like, or respectively jaw-like, and form a pre-fold 83 on the signature 78.

In the process, while the signature 78 is inserted into the pre-fold clamping gap 81, the point spurs of the point spur system 26 are pulled out of the leading element 79 of the signature 78 against the clockwise turning direction B of the transport and folding jaw cylinder 22 in a manner as disclosed in DE 195 33 064 A1 which corresponds to U.S. Pat. No. 5,860,342.

Because the enlargements or lobes 46, 47 of the supports 43, 44 are formed in a cylinder shape, the pre-fold 83 is formed as a bead or bulge on the other side of an imagined contact line of the two enlargements or lobes 46, 47 and radially inside the two pre-fold clamping elements 31, 32. For this reason, the pre-folded product 83, 79, 82 shaped in this way cannot slip out of the closed pre-fold clamping elements 31, 32 during the further transport on the pre-fold cylinder 27. Thus, the radius r of an enlargement or lobe 46, 47 is less than the penetration depth of a folding blade 23 into a pre-fold clamping gap 81. Following approximately a quarter revolution of the pre-fold cylinder 27, starting at the position 56 of the pre-fold depicted in FIG. 2 in the counterclockwise direction of rotation C, the pre-folded product, not represented, is received between the two belt systems 63, 64. After a more than half a revolution of the pre-fold cylinder 27 following the pre-folding process, the belt systems 63, 64 separate from the pre-fold cylinder 27 and represented in FIG. 1, wherein the first belt system 63 has just lifted the pre-folded product by its pre-fold 83, while the pre-fold clamping elements 31, 32 are opened, and thereafter both belt systems 63, 64 conduct the pre-folded product to the folding rollers 61, 62 for finish-folding.

After leaving the folding rollers 61, 62, the finish-folded printed product is transferred to the paddle wheel 69 and is thereafter deposited on the delivery belt 72.

Supplementing the already mentioned advantages, the advantages of pre-folding during two-stage transverse folding consist in that, because of the rounding of the portions of the pre-folding clamping elements near the periphery, there is a greater supported distance for the signature between the folding blade and the pre-fold clamping element than with known folding jaw systems. Because of this greater supported distance and the rounding of the portions near the periphery, it is possible to insert thick folded products without damage and with reduced force into the pre-fold clamping gap. Because of their large contact surfaces, the rounded pre-fold clamping elements treat the outer layers of the folded products gently. The inner layers of the folded product are treated gently in that the folding blade can roll off over the rounded pre-fold clamping elements without jamming the pre-folded product in the process.

In order to prevent the point spurs from tearing during the folding process, during their return, the point spurs are additionally moved back in respect to the front edge of the leading element of the signature by approximately the amount of the penetration depth of the folding blade into the pre-fold clamping gap.

While preferred embodiments of a method and device for cross-folding signatures in accordance with the present invention have been set forth fully and completely hereinabove, it will be apparent to one of skill in the art that a number of changes in, for example, the type of rotary printing press used, the drive assembly for the cylinders and the like could be made without departing from the true spirit and scope of the present invention which is accordingly to be limited only by the following claims.

What is claimed is:

1. A method for transversely folding signatures including:

providing a pre-fold cylinder;

providing a path of signature travel and locating said pre-fold cylinder in said path of signature travel;

positioning pre-fold clamping elements on said pre-fold cylinder;

directing signatures along said path of signature travel to said pre-fold cylinder;

placing said signatures between said pre-fold clamping elements;

providing a pre-fold in each of said signatures by using said pre-fold clamping elements;

providing a pair of rotating folding rollers along said path of signature travel and after said pre-fold cylinder;

directing said signatures provided with said pre-fold by using said pre-fold clamping elements to said pair of rotating folding rollers; and finish-folding said signatures provided with said pre-fold using said pair of rotating folding rollers.

2. The method of claim 1 further including providing a transport and folding blade cylinder having point spurs forming a signature transport system for delivery of said signatures to said pre-fold cylinder, providing said transport and folding blade cylinder with a first direction of rotation, and removing said point spurs from said signatures delivered to said pre-fold clamping elements in a direction opposite to said first direction of rotation.

3. The method of claim 1 further providing a paper guide system intermediate said pre-fold cylinder and said folding rollers, and using said paper guide system for guiding said signatures provided with said pre-fold to said folding rollers.

4. A device for transversely folding signatures comprising:

a transport and folding blade cylinder;

a pre-fold cylinder associated with said transport and folding blade cylinder to receive signatures traveling along a path of signature travel from said transport and folding blade cylinder;

pre-fold clamping element systems including folding jaws defining pre-fold clamping gaps on said pre-fold cylinder;

means for operating said pre-fold clamping element systems to produce pre-folded products from said signatures received from said transport and folding blade cylinder;

a pair of folding rollers located along said path of signature travel and after said pre-fold cylinder; and means delivering said pre-folded products from said pre-fold cylinder to said pair of folding rollers for formation of finish-folded products.

5. The device of claim 4 wherein a number of said pre-fold clamping element systems are arranged on a circumferential surface of said pre-fold cylinder and extend parallel to an axis of rotation of said pre-fold cylinder.

6. The device of claim 4 wherein each said pre-fold clamping element system includes a number of pairs of pre-fold clamping elements, said pre-fold clamping element pairs each cooperating in a jaw-like manner and being spaced apart from each other.

7. The device of claim 6 further including first and second shafts associated with, and supporting each said number of pairs of said pre-fold clamping elements, and a synchronizing device connecting ends of each of said first and second shafts.

8. The device of claim 7 wherein said synchronizing device includes toothed segments fixed on said shafts and in gear tooth engagement with each other.

9. The device of claim 7 wherein at least one of said first and second shafts of each said pre-fold clamping element is connected with a cam control.

10. The device of claim 9 further including a torsion bar arranged within each said shaft, a fixed end of said torsion bar being secured to said shaft and a second end of said torsion bar being secured to said pre-fold cylinder and being pre-stressed.

11. The device of claim 7 further including a torsion bar arranged within each said shaft, a fixed end of said torsion bar being secured to said shaft and a second end of said torsion bar being secured to said pre-fold cylinder and being pre-stressed.

12. The device of claim 6 wherein each said pre-fold clamping element includes a resilient finger-like support and a cylinder-shaped enlargement adjacent a circumferential surface of said pre-fold cylinder and extending parallel to an axis of rotation of said pre-fold cylinder.

13. The device of claim 12 wherein a radius of said cylinder-shaped enlargement on each said finger-like support is less than a depth of penetration of a folding blade of said transport and folding blade cylinder into said pre-fold clamping gaps.

14. The device of claim 12 wherein each said support and said enlargement is one piece.

15. The device of claim 6 wherein each of said pre-fold clamping elements has a lobed radius outer end adjacent a circumferential surface of said pre-fold cylinder and engageable with each said pre-fold products.

16. The device of claim 4 further including a paper guide system arranged between said pre-fold cylinder and said pair of folding rollers.

17. The device of claim 16 wherein said paper guide system includes a first belt system supported about said pre-fold cylinder and passing around a first folding roller of said pair of folding rollers.

18. The device of claim 17 further including a second belt system supported by belt guide rollers adjacent said pre-fold cylinder and passing around a second folding roller of said pair of folding rollers.

* * * * *